US009074490B2

(12) United States Patent
Benkler et al.

(10) Patent No.: US 9,074,490 B2
(45) Date of Patent: Jul. 7, 2015

(54) GAS TURBINE

(75) Inventors: Francois Benkler, Ratingen (DE); Tobias Buchal, Düsseldorf (DE); Andreas Böttcher, Ratingen (DE); Martin Hartmann, Bochum (DE); Patricia Hülsmeier, Münster (DE); Uwe Kahlstorf, Mülheim a.d. Ruhr (DE); Ekkehard Maldfeld, Mülheim an der Ruhr (DE); Dieter Minninger, Dinslaken (DE); Michael Neubauer, Berlin (DE); Peter Schröder, Essen (DE); Rostislav Teteruk, Mülheim an der Ruhr (DE); Vyacheslav Veitsman, Gelsenkirchen (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 790 days.

(21) Appl. No.: 13/129,633

(22) PCT Filed: Sep. 15, 2009

(86) PCT No.: PCT/EP2009/061936

§ 371 (c)(1),
(2), (4) Date: Jul. 29, 2011

(87) PCT Pub. No.: WO2010/057698

PCT Pub. Date: May 27, 2010

(65) Prior Publication Data

US 2011/0280721 A1 Nov. 17, 2011

(30) Foreign Application Priority Data

Nov. 19, 2008 (EP) ..... 08020190

(51) Int. Cl.
*F01D 25/24* (2006.01)
*F01D 25/26* (2006.01)

(52) U.S. Cl.
CPC ..... *F01D 25/246* (2013.01); *F01D 25/26* (2013.01)

(58) Field of Classification Search
CPC ..... F01D 11/14; F01D 11/16; F01D 11/18; F01D 25/26; F01D 25/265; F04D 1/066
USPC ..... 415/127, 131, 132, 140, 173.2, 174.2, 415/209.2; 416/189, 190
See application file for complete search history.

(56) References Cited

U.S. PATENT DOCUMENTS 3,169,748 A * 2/1965 Howard et al. ..... 415/209.2
4,426,191 A 1/1984 Brodell (Continued)

FOREIGN PATENT DOCUMENTS

DE 102006038021 A1 3/2007
EP 1022439 A1 7/2000

(Continued)

*Primary Examiner* — Edward Look
*Assistant Examiner* — Aaron R Eastman

(57) ABSTRACT

A gas turbine including a plurality of hook elements disposed one inside the other and designed substantially in the form of hollow cones or hollow cylinders, and including a stator blade support, is intended to enable an especially high efficiency while maintaining the greatest possible operating safety and operating life. To this end, at least one of the hook elements or the stator blade support has a substantially elliptical cross-sectional contour.

6 Claims, 2 Drawing Sheets

(56) References Cited

U.S. PATENT DOCUMENTS

| | | | | |
|---|---|---|---|---|
| 5,063,661 | A * | 11/1991 | Lindsay | 29/888.02 |
| 5,605,438 | A * | 2/1997 | Burdgick et al. | 415/182.1 |
| 6,691,019 | B2 * | 2/2004 | Seeley et al. | 701/100 |
| 7,220,097 | B2 * | 5/2007 | Boeck | 415/14 |
| 7,261,300 | B2 * | 8/2007 | Agrawal et al. | 277/399 |
| 2003/0143063 | A1 * | 7/2003 | Coxhead et al. | 415/9 |
| 2004/0120617 | A1 * | 6/2004 | Fournier et al. | 384/105 |
| 2010/0080698 | A1 * | 4/2010 | Flanagan et al. | 415/213.1 |

FOREIGN PATENT DOCUMENTS

| | | | |
|---|---|---|---|
| JP | 54081409 | A | 6/1979 |
| JP | 58160502 | | 9/1983 |
| JP | 62126225 | | 6/1987 |
| JP | 2002256812 | A | 9/2002 |
| JP | 2002529646 | A | 9/2002 |
| JP | 2005042612 | A | 2/2005 |

* cited by examiner

GAS TURBINE

CROSS REFERENCE TO RELATED APPLICATIONS

This application is the US National Stage of International Application No. PCT/EP2009/061936, filed Sep. 15, 2009 and claims the benefit thereof. The International Application claims the benefits of European Patent Office application No. 08020190.8 EP filed Nov. 19, 2008. All of the applications are incorporated by reference herein in their entirety.

FIELD OF INVENTION

The invention relates to a gas turbine having a stator blade support, which is essentially hollow-conical or hollow-cylindrical and extends along a machine axis, and having an outer wall, which is essentially hollow-conical or hollow-cylindrical and is segmented into annular segments in the circumferential and/or axial direction, of an annular hot gas path, whose annular segments are attached by means of a number of hook elements to the inside of the stator blade support.

BACKGROUND OF INVENTION

Gas turbines are used in many fields, for driving generators or working machines. In this case, the energy content of a fuel is used to produce a rotary movement of a turbine shaft. The fuel is for this purpose burnt in a combustion chamber, with compressed air being supplied from an air compressor. The working medium which is produced by the combustion of the fuel in the combustion chamber and is at high pressure and high temperature is in this case passed via a turbine unit, which is connected downstream from the combustion chamber and where it is expanded producing work.

In this case, in order to produce the rotary movement of the turbine shaft, a number of rotor blades are arranged on the turbine shaft, are normally combined to form blade groups or blade rows and drive the turbine shaft via the impulse which is transmitted from the working medium. Furthermore, stator blades, which are normally connected to the turbine housing between adjacent stator blade rows and are combined to form stator blade rows, are normally provided to guide the flow of the working medium. These stator blades are attached to a normally hollow-cylindrical or hollow-conical stator blade support.

When designing gas turbines such as these, in addition to the power which can be achieved, particularly high efficiency is normally a design aim. In this case, for thermodynamic reasons, the efficiency can in principle be increased by increasing the outlet temperature at which the working medium flows out of the combustion chamber and into the turbine unit. In this case, temperatures of about 1200° C. to 1500° C. are both desired and achieved for gas turbines such as these.

However, when the working medium is at high temperatures such as these, the components and parts which are subject to these temperatures are subject to high thermal loads. The hot gas channel is normally clad by so-called annular segments, which form axial sections of the outer wall of the hot gas channel. These are normally attached via hook elements to the stator blade support, as a result of which the totality of the annular segments in the circumferential direction, in the same way as the stator blade support, forms a hollow-conical or hollow-cylindrical structure.

The components of the gas turbine can be deformed by different thermal expansion in different operating states, and this has a direct influence on the size of the radial gaps between the rotor blades and the outer wall of the hot gas channel. These radial gaps may be of different size while the turbine is being run up and shut down than during normal operation. When designing the gas turbine, components such as the stator blade support or outer wall must always be designed such that the radial gaps are kept sufficiently large to prevent the gas turbine from being damaged in any operating state. However, a correspondingly comparatively generous design of the radial gaps leads to considerable efficiency losses.

In order to overcome this problem, JP 2005-042612 proposes that the stator blade support being designed such that it can be cooled, with the aim of reducing the thermally dependent deformation. According to JP 54-081409, this problem is intended to be solved by a plurality of gas bleed chambers, which leads to uniform stiffness of the upper and lower housing part.

SUMMARY OF INVENTION

Therefore, the invention is based on the object of specifying a gas turbine which allows particularly high efficiency while maintaining the greatest possible operational safety and life.

According to the invention, this object is achieved in that the hook elements on at least one of the annular segments of the gas turbine as mentioned initially are geometrically matched such that, when not in operation, the outer wall which bounds the hot gas path has an essentially elliptical cross-sectional contour in a section at right angles to the machine axis.

The invention is in this case based on the idea that particularly high efficiency would be made possible by reducing the radial gaps during normal operation, that is to say, for example, during full-load operation of the gas turbine. Until now, it was necessary to design the radial gaps to be comparatively large, because the turbine deforms differently in different operating states. In particular, cylindrically or conically shaped components of the gas turbine become oval, and this must be taken into account when designing the radial gaps. In order to allow the radial gaps to be reduced during the design of the gas turbine, the ovality during operation of the gas turbine should therefore be kept as small as possible. This should be achieved by an appropriately matched cross-sectional contour of the hollow-conical or hollow-cylindrical components of the gas turbine when they are not in operation, that is to say when the gas turbine has cooled down to room temperature. This cross-sectional contour should be designed such that the cross-sectional contour which exists at room temperature after assembly of the gas turbine leads to a cross-sectional contour which is then circular, as a result of the thermal deformations which occur in the operating state. This can be achieved by geometrically matching the hook elements on at least one of the annular segments such that, when not in operation, the outer wall which bounds the hot gas path has an essentially elliptical cross-sectional contour in a section at right angles to the machine axis. The thermal expansion should accordingly not be suppressed, as in the prior art according to JP 2005-042612 and JP 54-081409.

It is relatively simple to appropriately manufacture the annular segments described initially, with which the hot gas path outside the rotor blades is clad. The annular segments form the outer wall of the hot gas path in the axial section of the rotor blades in the circumferential direction and together therefore form the hollow-conical or hollow-cylindrical component of the gas turbine which is closest to the rotor blades.

The cross section at right angles to the machine axis through the annular segments which form the outer wall of the hot gas path therefore has the described elliptical cross-sectional contour when not in operation.

The annular segments which form the outer wall of the hot gas path in the axial section of the rotor blades are in this case normally hooked into the stator blade support via hook elements. Since the stator blade support is a relatively massive component which is subject to comparatively severe deformation during operation, the cross-sectional contour which is formed by all the annular segments in the operating state is frequently governed by the attachment or bracing of the annular segments in the stator blade support, and its deformation during operation. It is therefore not absolutely essential for the cold contour of the outer wall, which consists of annular segments, to be manufactured itself in an elliptical shape, since the definition which is forced by the contact points on the hook elements occurs in any case. The compensation for the ovality of the stator blade support can therefore be achieved by advantageously matching only the individual hook elements of the annular segments such that the outer wall has an essentially elliptical cross-sectional contour. Since these annular segments are replaceable maintenance parts, this on the one hand makes it possible to retrofit existing gas turbines while on the other hand making it possible to compensate for manufacturing errors in stator blade supports and, furthermore, allowing particularly simple matching to different methods of operation, including modified other measures to reduce the radial gaps.

In one advantageous refinement, during the production of the hollow-conical or hollow-cylindrical components of the gas turbine, the lengths of the main and secondary axes of the elliptical cross-sectional contour are in each case chosen such that the respective component has an essentially circular cross-sectional contour after the thermal deformation which occurs in the operating state. This can be done, for example, by introduction of ovality offset through 90 degrees with respect to that expected during operation. The elliptical shape of these components is therefore chosen such that the deformations in the operating state are compensated for precisely, such that this results in a circular cross section during operation, and therefore in the same radial gaps over the entire circumference of the gas turbine, that is to say the radial gaps no longer vary over the circumference. Even during the design phase, this therefore allows the radial gaps to be designed to be correspondingly narrow, resulting in higher efficiency of the gas turbine.

Advantageously, the radial lengths of the hook elements are matched, and/or enclosures are arranged in a corresponding holding groove in the stator blade support, in order to vary the radial position of the hook elements. These enclosures are then located between the hooks of the hook elements and the holding groove and therefore lead, seen along the circumference, to different radial positions of the annular segments. Annular segments having radial hooks of different length can therefore de facto either be provided in the stator blade support, distributed along the circumference, or the hook elements of the annular segments are identical along the circumference, in which case enclosures of different thickness are then used for the corresponding hooks, in order to vary the radial position of the annular segments along the circumference.

The explained elliptical configuration of the hollow-conical or hollow-cylindrical components of the gas turbine when not in operation makes it possible to achieve an essentially circular shape for the operating state and, furthermore, the elliptical shape which now exists when not in operation can be taken into account further in the design of the radial gaps and the design of the gas turbine. This problem can be overcome by a gas turbine which is equipped with the described components that have been manufactured with an opposing angle design having a bearing device for the turbine shaft, which is designed such that the turbine shaft can be moved along the turbine axis. This allows the turbine shaft to be moved in the hot gas flow direction in the cold operating state, thus resulting in the radial gaps being enlarged when the outer wall has a hollow-conical shape, with an enlargement of the radius in the direction of the hot gas flow when cold and not in operation, as a result of which the opposing ovality which is still present in the cold state (for example when starting up the gas turbine) does not represent any restriction to the radial gaps which can be achieved in the hot state. This makes it possible to achieve even higher efficiency from the gas turbine.

A gas turbine such as this is advantageously used in a gas and steam turbine installation.

The advantages achieved by the invention are, in particular, that deliberately designing the hollow-conical or hollow-cylindrical components of a gas turbine such that they have an essentially elliptical cross-sectional contour when not in operation, allows the gas turbine to have a particularly high efficiency, by reducing the radial gaps. The previous elliptical deformation, for example of the outer wall of the annular hot gas channel or the inner wall of the stator blade support during operation, is reduced or avoided by elliptical manufacture, in which the ovality which is incorporated in the cold state is rotated through 90° with respect to the ovality which occurs during operation. Unifying the radial gaps on the circumference reduces the flow losses and therefore improves the machine efficiency. In addition, the cold gaps when in the new state can be reduced, since the amount of the ovality need no longer be kept available for gap generation.

BRIEF DESCRIPTION OF THE DRAWINGS

The invention will be explained in more detail with reference to a drawing, in which.

The same parts are provided with the same reference symbols in all the figures.

DETAILED DESCRIPTION OF INVENTION

Figure 1:
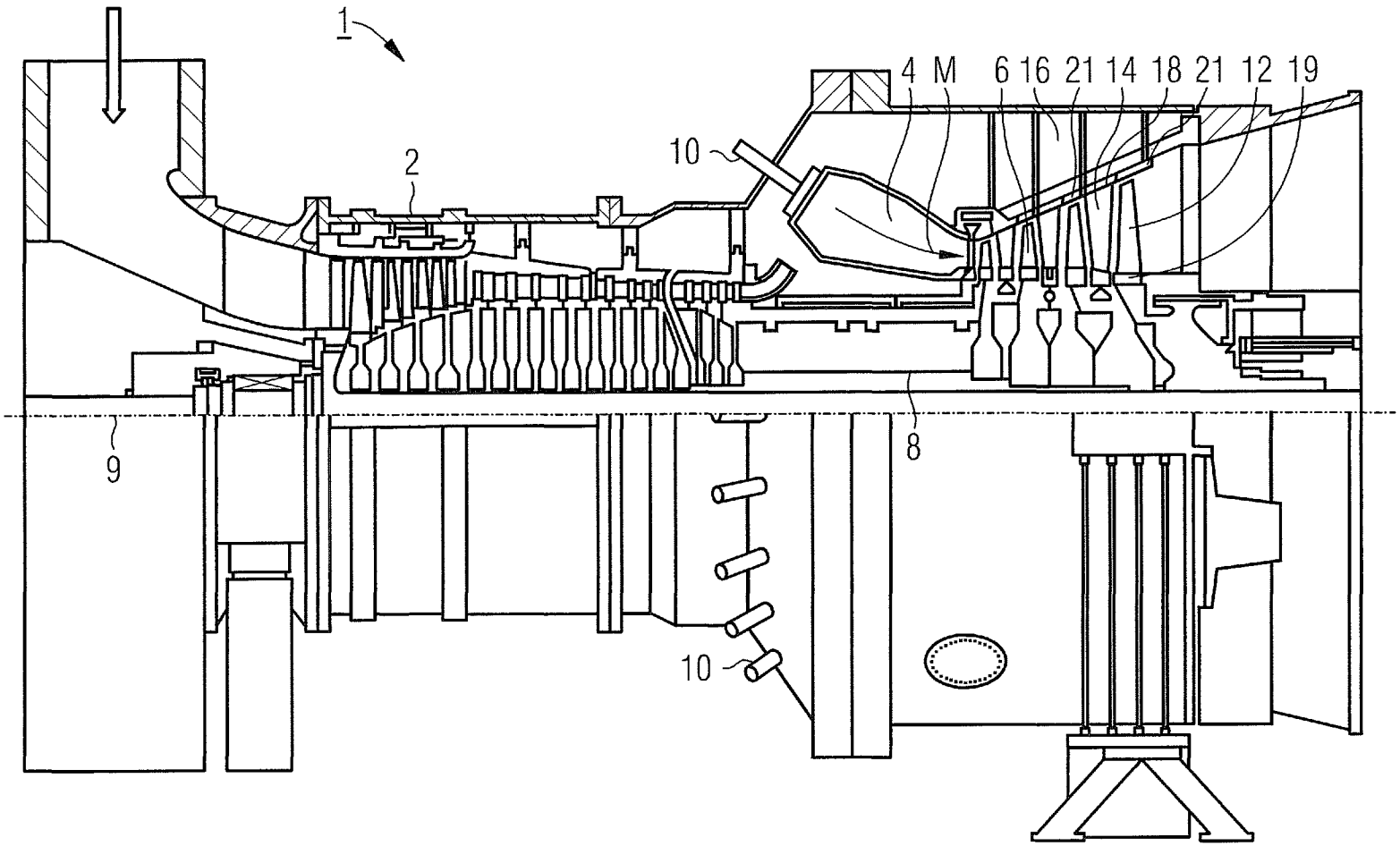
FIG. 1 shows a half section through a gas turbine.

The gas turbine 1 as shown in FIG. 1 has a compressor 2 for combustion air, a combustion chamber 4 and a turbine unit 6 for driving the compressor 2, and for driving a generator, which is not illustrated, or a working machine. For this purpose, the turbine unit 6 and the compressor 2 are arranged on a common turbine shaft 8, which is also referred to as the turbine rotor, to which the generator and/or the working machine are/is also connected, and which is mounted such that it can rotate about its turbine axis 9. The combustion chamber 4, which is in the form of an annular combustion chamber, is fitted with a number of burners 10 for combustion of a liquid or gaseous fuel.

The turbine unit 6 has a number of rotor blades 12 which can rotate and are connected to the turbine shaft 8. The rotor blades 12 are arranged in the faun of a ring on the turbine shaft 8 and therefore foam a number of rotor blade rows. Furthermore, the turbine unit 6 comprises a number of stationary stator blades 14, which are likewise attached in the form of a ring to a stator blade support 16 in the turbine unit 6, forming the stator blade rows. The rotor blades 12 are in this case used to drive the turbine shaft 8 by impulse transmission from the working medium M flowing through the turbine unit 6. In contrast, the stator blades 14 are used for flow guidance of the working medium M between in each case two successive rows of rotor blades or rings of rotor blades which follow one another, seen in the flow direction of the working medium M. A successive pair from a ring of stator blades 14 or a row of stator blades and from a ring of rotor blades 12 or a row of rotor blades is in this case also referred to as a turbine stage.

Each stator blade 14 has a platform 18 which is arranged as a wall element, in order to fix the respective stator blade 14 to a stator blade support 16 in the turbine unit 6. In this case, the platform 18 is a thermally comparatively severely loaded component, which forms the outer boundary of a hot gas channel for the working medium M flowing through the turbine unit 6. Each rotor blade 12 is analogously attached to the turbine shaft 8 via a platform 19, which is also referred to as a blade foot.

Annular segments 21 are in each case arranged on a stator blade support 16 in the turbine unit 6, between the platforms 18, which are arranged separated from one another, of the stator blades 14 in two adjacent stator blade rows. The inner surface of each annular segment 21 is in this case likewise subject to the hot working medium M flowing through the turbine unit 6, and accordingly bounds the annular hot gas path on the outside, as its outer wall. In the radial direction, the outer wall is separated by a radial gap from the outer end of the rotor blades 12 opposite it. The annular segments 21 which are arranged between adjacent stator blade rows are in this case used in particular as shroud elements, which protect the stator blade support 16 or other housing built-in parts against thermal overloading from the hot working medium M flowing through the turbine 6.

In the exemplary embodiment, the combustion chamber 4 is in the form of a so-called annular combustion chamber, in which a multiplicity of burners 10, which are arranged around the turbine shaft 8 in the circumferential direction, open into a common combustion chamber area. For this purpose, the combustion chamber 4 is in its totality in the form of an annular structure, which is positioned around the turbine shaft 8.

Figure 2:
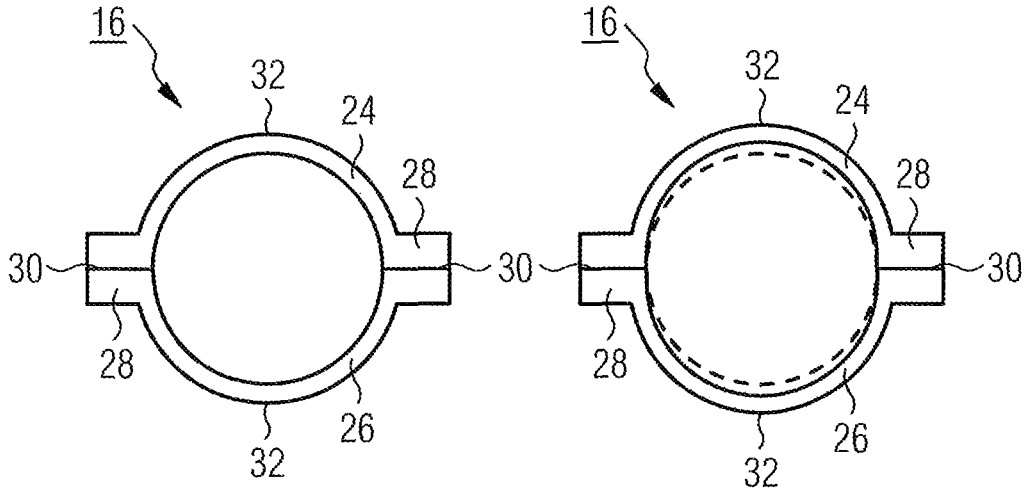
FIG 2 PRIOR ART
FIG. 2 shows a cross section through the stator blade support of a gas turbine according to the prior art.
Figure 3:
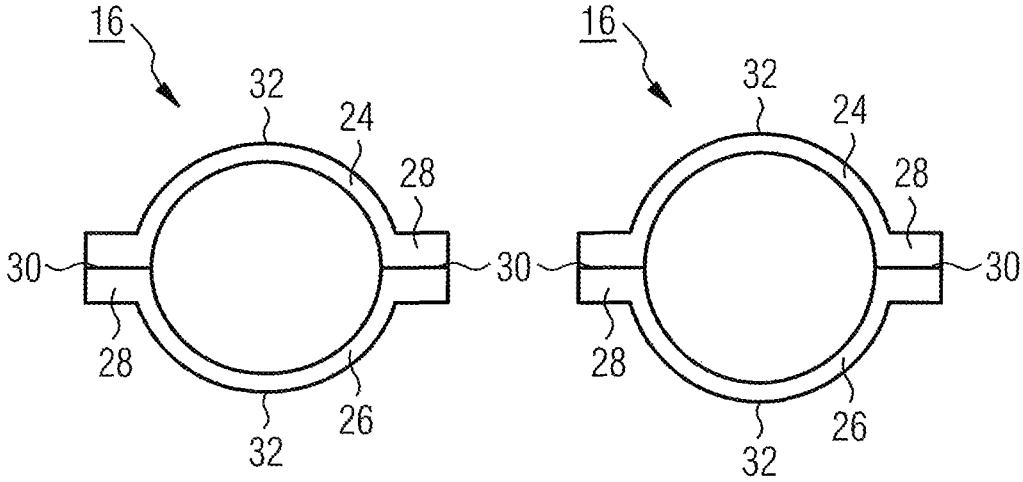
FIG. 3 shows a cross section through the stator blade support of a gas turbine with an elliptical shape introduced when not in operation.

FIGS. 2 and 3 now schematically show the stator blade support 16 for the gas turbine 1 in the form of a cross section at right angles to the turbine axis 9, on the one hand on the left when not in operation, that is to say when the gas turbine 1 is cold, and on the right in the operating state, that is to say at the operating temperature. When not in operation, the stator blade support 16 is accordingly at a material temperature which corresponds to the ambient temperature of the gas turbine. The operating temperature, in contrast, is considerably higher; beyond 100° C. The stator blade support 16 is in this case composed of an upper segment 24 and a lower segment 26. The two segments 24, 26 are connected to one another via flanges 28, and each form a connecting joint 30 at their connecting point.

During operation, as is illustrated on the right in FIG. 2, the high operating temperatures in the gas turbine 1 result in deformation of the stator blade support 16 according to the prior art, such that the distance between the peaks 32 of the respective upper and lower parts 24, 26 is increased. The cross section of the stator blade support 16 is in this case deformed to form a vertical ellipse. A circular contour is illustrated, in the form of dashed lines, for comparison.

This deformation can now be compensated for by deliberately introducing an elliptical configuration for the cross section of the stator blade support 16 when cold and not in operation, as is illustrated in FIG. 3. When not in operation, the distance between the peaks 32 of the upper and lower segments 24, 26 is shortened, that is to say the cross section when not in operation is in the form of a horizontal ellipse, as is illustrated on the left in FIG. 3. The thermally dependent expansion and enlargement of the distance between the peaks 32 in operation, as is illustrated on the right, then results in the stator blade support 16 having an essentially circular shape, as is shown on the right in FIG. 3.

In order to avoid any restrictions resulting from the ovality introduced in terms of the radial gap when not in operation, the turbine shaft 8 can be moved along the turbine axis 9. In the cold state, that is to say when the hot gas channel has an elliptical shape, the turbine shaft 8 can then be moved in the direction of the hot gas flow direction. The conical shape of the hot gas channel results in the radial gap being enlarged. When a circular cross section then occurs as a result of thermal deformation in the operating state, the turbine shaft 8 is moved in the opposite direction, in order to optimize the radial gap.

Alternatively, the annular segments 21 can also be configured by correspondingly introduced ovality such that the hot gas channel has a circular cross section during operation. For this purpose, the hook elements for attachment of the annular segments 21 to the stator blade support 16 may have different lengths, that is to say they may have different lengths with different circumferential positions, or enclosures can be introduced between the hooks and holding groove on the stator blade support 16, which influence the radial position of the relevant annular segments 21 by means of hook elements of the same length. This is because the cross-sectional contour at right angles to the machine axis through the radially outer wall, which is formed from the annular segments 21, of the annular hot gas channel is largely determined by the deformation of the stator blade support 16, which is passed on through the hook elements of the annular segments. Accordingly, instead of the stator blade support 16, as shown in FIG. 2 and FIG. 3, this can also mean an outer wall—which then has no flange—of the hot gas path through a gas turbine.

The ovality in the operating state can be avoided by such elliptical shaping of the stator blade support 16 or of the outer wall, which consists of annular segments, of the hot gas channel of the gas turbine 1. When designing the gas turbine 1, this makes it possible to make the radial gaps correspondingly smaller, which overall results in the gas turbine 1 having a considerably higher efficiency without any operational reliability losses.

The invention claimed is:

1. A gas turbine, comprising:

a stator blade support, which is essentially hollow-conical or hollow-cylindrical and extends along a machine axis; and an outer wall, which is essentially hollow-conical or hollow-cylindrical and is segmented into a plurality of annular segments in a circumferential and/or axial direction, of an annular hot gas path, and whose plurality of annular segments are attached by means of a plurality of hook elements to an inside of the stator blade support by a connecting joint, wherein the hook elements of at least one of the plurality of annular segments are geometrically matched such that the outer wall which bounds the hot gas path has a variable cross-sectional contour, the variability of the contour ranging from an essentially elliptical cross-sectional contour in a section at right angles to the machine axis when gas in the hot gas path is at room temperature, to an essentially circular cross-sectional contour after a thermal deformation which occurs as the gas rises above room temperature, wherein a plurality of radial lengths of the plurality of hook elements are matched such that the plurality of hook elements have different lengths with different circumferential positions in order for the outer wall to have a variable cross-sectional contour, and wherein shims for different radial positions of the plurality of hook elements are arranged in an annular groove in the stator blade support.

2. The gas turbine as claimed in claim 1, wherein a first length of a main axis and a second length of a secondary axis of the elliptical cross-sectional contour are in each case chosen such that the outer wall has an essentially circular cross-sectional contour after a thermal deformation which occurs in an operating state.

3. The gas turbine as claimed in claim 1, further comprising:

a turbine shaft including a plurality of rotor blades, which are grouped to form rotor blade rows and are arranged circumferentially.

4. A gas and steam turbine installation, comprising:

a gas turbine, comprising:

a stator blade support, which is essentially hollow-conical or hollow-cylindrical and extends along a machine axis, and an outer wall, which is essentially hollow-conical or hollow-cylindrical and is segmented into a plurality of annular segments in a circumferential and/or axial direction, of an annular hot gas path, and whose plurality of annular segments are attached by means of a plurality of hook elements to an inside of the stator blade support by a connecting joint, wherein the hook elements of at least one of the plurality of annular segments are geometrically matched such that the outer wall which bounds the hot gas path has a variable cross-sectional contour, the variability of the contour ranging from an essentially elliptical cross-sectional contour in a section at right angles to the machine axis when gas in the hot gas path is at room temperature, to an essentially circular cross-sectional contour after a thermal deformation which occurs as the gas in the hot gas path rises above room temperature, wherein a plurality of radial lengths of the plurality of hook elements are matched such that the plurality of hook elements have different lengths with different circumferential positions in order for the outer wall to have a variable cross-sectional contour, and wherein shims for different radial positions of the plurality of hook elements are arranged in an annular groove in the stator blade support.

5. The installation as claimed in claim 4, wherein a first length of a main axis and a second length of a secondary axis of the elliptical cross-sectional contour are in each case chosen such that the outer wall has an essentially circular cross-sectional contour after a thermal deformation which occurs in an operating state.

6. The installation as claimed in claim 4, further comprising:

a turbine shaft including a plurality of rotor blades, which are grouped to form rotor blade rows and are arranged circumferentially.

* * * * *